US011058926B2

(12) United States Patent
Duval

(10) Patent No.: US 11,058,926 B2
(45) Date of Patent: Jul. 13, 2021

(54) MONOFILAMENT STRING FOR A RACKET AND PROCESS FOR MANUFACTURING SUCH A MONOFILAMENT STRING

(71) Applicant: SPEED FRANCE SAS, Arnas (FR)

(72) Inventor: Sebastien Duval, Sainte Eupheme (FR)

(73) Assignee: SPEED FRANCE SAS, Arnas (FR)

( * ) Notice: Subject to any disclaimer, the term of this patent is extended or adjusted under 35 U.S.C. 154(b) by 0 days.

(21) Appl. No.: 16/624,819

(22) PCT Filed: Jun. 20, 2018

(86) PCT No.: PCT/EP2018/066399
§ 371 (c)(1),
(2) Date: Dec. 19, 2019

(87) PCT Pub. No.: WO2018/234376
PCT Pub. Date: Dec. 27, 2018

(65) Prior Publication Data

US 2020/0121993 A1 Apr. 23, 2020

(30) Foreign Application Priority Data

Jun. 21, 2017 (EP) ..... 17305764

(51) Int. Cl.
*A63B 51/02* (2015.01)
*D01D 5/34* (2006.01)
*D01F 8/12* (2006.01)

(52) U.S. Cl.
CPC ..... *A63B 51/02* (2013.01); *D01D 5/34* (2013.01); *D01F 8/12* (2013.01); *D10B 2331/02* (2013.01)

(58) Field of Classification Search
CPC ..... A63B 51/02; D10B 2331/02; D01F 8/12; D01D 5/34; D02G 3/00
See application file for complete search history.

(56) References Cited

U.S. PATENT DOCUMENTS 4,382,358 A * 5/1983 Tappe ..... A63B 51/02 264/210.8
4,391,088 A * 7/1983 Salsky ..... A63B 51/02 273/0.23 DIG (Continued)

FOREIGN PATENT DOCUMENTS

EP 0319191 A2 * 6/1989 ..... A63B 51/02
EP 2159305 A1 3/2010

(Continued)

OTHER PUBLICATIONS

European Search Report and Search Opinion received for EP Patent Application No. 17305764.7, dated Jan. 25, 2018, 6 pages.

(Continued)

*Primary Examiner* — Raleigh W Chiu
(74) *Attorney, Agent, or Firm* — Womble Bond Dickinson (US) LLP

(57) ABSTRACT

The present invention relates to a monofilament string for a racket, comprising a core consisting of a single filament and a sheath extending around the core and in contact with the core, the monofilament string being characterized in that:

the core (2) is made of a first material comprising polyamide 6 and a first copolymer of polyamide 6 and polyamide 6.6, the sheath (3) is made of a second material comprising a second copolymer of polyamide 6 and polyamide 6.6, the first material having a greater tensile modulus than the second material.

The present invention also related to a process for manufacturing such a filament string, by co-extrusion of the core and the sheath and stretching of the co-extruded string.

16 Claims, 4 Drawing Sheets

(56) References Cited

U.S. PATENT DOCUMENTS

| | | | | | |
|---|---|---|---|---|---|
| 4,660,364 | A * | 4/1987 | Chiang | A63B 51/02 | 57/210 |
| 4,860,531 | A * | 8/1989 | Wells | A63B 51/02 | 57/234 |
| 5,327,714 | A * | 7/1994 | Stevens | A63B 51/02 | 273/0.6 DIG |
| 6,460,321 | B1 * | 10/2002 | Koshimae | A63B 51/02 | 57/210 |
| 8,713,906 | B2 * | 5/2014 | Yaniv | D02G 3/444 | 57/232 |
| 2005/0160714 | A1 * | 7/2005 | Delvael | D07B 1/02 | 57/232 |
| 2005/0245333 | A1 * | 11/2005 | Akagi | B82Y 30/00 | 473/537 |
| 2008/0124546 | A1 * | 5/2008 | Yaniv | D07B 1/165 | 428/377 |
| 2010/0041829 | A1 * | 2/2010 | Van Malderen | D01F 1/10 | 525/94 |
| 2011/0136601 | A1 * | 6/2011 | Hirata | A63B 51/02 | 473/524 |
| 2011/0201462 | A1 * | 8/2011 | Onnis | A63B 51/02 | 473/543 |
| 2012/0237767 | A1 * | 9/2012 | Yaniv | G10D 3/10 | 428/377 |
| 2020/0023241 | A1 * | 1/2020 | Beyltiens | D01D 5/36 | |

FOREIGN PATENT DOCUMENTS

| | | | | |
|---|---|---|---|---|
| EP | 3418433 | A1 * | 12/2018 | D02G 3/444 |
| FR | 2934958 | A1 | 2/2010 | |
| JP | 2011-125584 | A | 6/2011 | |
| JP | 2016-056487 | A | 4/2016 | |
| WO | 01/61087 | A1 | 8/2001 | |

OTHER PUBLICATIONS

International Preliminary Report on Patentability received for PCT Patent Application No. PCT/EP2018/066399, dated Jan. 2, 2020, 7 pages.

International Search Report and Written Opinion received for PCT Patent Application No. PCT/EP2018/066399, dated Jul. 24, 2018, 9 pages.

* cited by examiner

MONOFILAMENT STRING FOR A RACKET AND PROCESS FOR MANUFACTURING SUCH A MONOFILAMENT STRING

TECHNICAL FIELD OF THE INVENTION

The present invention relates to a monofilament string and a set of such monofilament strings for a racket such as a tennis racket, a squash racket, a badminton racket, or the like. The present invention also relates to a process for manufacturing such a monofilament string.

TECHNICAL BACKGROUND

In the field of racket sports, a racket is made of a handle and a hoop, a set of strings extending in two orthogonal directions across the hoop and being intended to undergo the impact of a ball, a shuttlecock or the like.

The evolution of the technology in this domain has pushed towards rackets being more and more competitive, involving great improvement in the structure and manufacture of the strings, in particular with regard to the materials constitutive of the strings.

From a general point of view, what is sought is to have a racket whose strings show good, or at least average, power, control, comfort, and durability properties. Power properties refer to the ability of the strings to increase the speed of the ball getting out of the strings when the player hits the ball. Control properties refer to the ability of the strings to influence the behavior of the ball, thus resulting in the possibility for the player to hit the ball towards a predetermined position with accuracy, to slow down the ball, and to influence the spin of the ball. Comfort properties refer to the ability of the strings to reduce the vibrations of the racket resulting from the strings undergoing the impact of the ball when the player hits the ball. And finally, durability properties refer to strings having a reduced degradation of their structure over time and use, which results in particular in a reduced tension loss, thus allowing them to keep their power, control, and/or comfort properties.

Among the different types of strings, strings made of natural guts have a low stiffness, which allows the player to accelerate the ball with no need of a high physical strength. However, they provide a poor control of the ball. Same goes for multifilament strings usually made of polyamide.

Monofilament strings are usually made of polyethylene, polyester, or polyamide. Monofilaments made of polyethylene and polyester have a high stiffness, which allow the player to be precise and to have a good control of the ball. However, the player needs to have a high physical strength in order to accelerate the ball. Monofilaments made of polyamide show these characteristics while providing a great ability to dissipate the vibrations of the racket as well, but tend to degrade and to lose tension fast.

Therefore, there is a need for monofilament strings that show a good balance between power and control properties, while having also good comfort and durability properties.

In particular, there is a need for monofilament strings that show high power properties, so that the player can easily increase the speed of the ball with no need of a high physical strength, while allowing the player to have a good control of the ball, and that maintain a substantially constant tension over time for a reasonable amount of time (preferably the time of a match, which is several hours, notably 2 to 4 hours, for an experienced player).

The document FR 2 934 958 aims to enhance the durability of a racket string, and discloses a monofilament string that comprises a central core, a peripheral protective layer, and an intermediate reinforcing layer made of a composite material, positioned between the central core and the peripheral protective layer.

The intermediate reinforcing layer increases the durability of the strings by increasing their rigidity at the expense of their elasticity, but this causes the strings to have reduced power properties as their ability to bend at the impact of a ball is reduced.

BRIEF DESCRIPTION OF THE INVENTION

An object of the invention is to provide a monofilament string for a racket, comprising a core consisting of a single filament and a sheath extending around the core and in contact with the core, wherein:

- the core is made of a first material comprising polyamide 6 and a first copolymer of polyamide 6 and polyamide 6.6,
- the sheath is made of a second material comprising a second copolymer of polyamide 6 and polyamide 6.6, the first material having a greater tensile modulus than the second material.

According to other optional features of the monofilament string:

- the first material comprises:
  - from 70% to 90% by weight, preferably from 75% and 85% by weight, of polyamide 6 with reference to the total weight of the first material,
  - from 10% to 30% by weight, preferably from 15% to 25% by weight of the first copolymer of polyamide 6 and polyamide 6.6 with reference to the total weight of the first material;
- according to an embodiment, the second material consists of or consists essentially of the second copolymer of polyamide 6 and polyamide 6.6; by "consists of or consists essentially of" is meant in the present text that the second material only comprises one type of polymer (here, the copolymer 6/6.6), but not excluding the presence of additives, such as slip agents or hydrophobic agents. According to a preferred embodiment, the second material consisting essentially of the copolymer 6/6.6 comprises at least 95% by weight of the copolymer 6/6.6, preferably at least 98% by weight of the copolymer 6/6.6, relative to the total weight of the second material;
- the sheath represents from 5% to 20% by weight, preferably from 8% to 16% by weight, of the total weight of the string;
- the core represents from 80% to 95% by weight, more preferably from 84% to 92% by weight, of the total weight of the string;
- the thickness of the sheath represents from 2% to 7%, preferably from 3% to 6%, of the total thickness of the string;
- the thickness of the core represents from 93% to 98%, preferably from 94% to 97%, of the total thickness of the string;
- the core has a thickness comprised between 1200 and 1500 micrometers, and the sheath has a thickness comprised between 20 and 50 micrometers;
- the second material further comprises at least one additive selected from the group consisting of: slip agents and hydrophobic agents;
- the monofilament string is obtained by co-extrusion of the core and the sheath.

Another object of the invention is a process for manufacturing a monofilament string for a racket as described above, the process comprising a co-extrusion of the core and the sheath to make the string and at least one stretching step of the string.

According to other optional features of the process:

the process further comprises the following steps:

a first stretching of the co-extruded string by applying a first predetermined traction force, wherein the ratio of the length of the co-extruded string in the stretched state to the length of the co-extruded string in the relaxed state is comprised between 1 and 10, preferentially between 3.5 and 4.5, a second stretching of the string by applying a second predetermined traction force, wherein the ratio of the length of the co-extruded string in the stretched state to the length of the co-extruded string in the relaxed state is comprised between 1 and 2, preferentially between 1.05 and 1.55.

the first and second stretching steps are continuous. In other words, the second stretching is performed right after the first stretching, after the string got back to the relaxed position;

the first and second stretching steps are preferably sequential. In other words, the string is let at rest for a predetermined amount of time after the first stretching, then the second stretching is performed;

at least one additive selected from the group consisting of slip agents and hydrophobic agents is added to the second material during the co-extrusion step. Preferably, the at least one additive is added continuously during at least one part of the co-extrusion step. Moreover, the at least one additive is preferably added to the second material at the outer surface of the sheath.

Another object of the invention is a racket comprising a set of monofilaments strings as described above.

BRIEF DESCRIPTION OF THE DRAWINGS

Further features and advantages of the invention will become apparent from the detailed description to follow, with reference to the appended drawings, in which.

DETAILED DESCRIPTION OF EMBODIMENTS OF THE INVENTION

The invention proposes a monofilament string for a racket.

Figure 1:
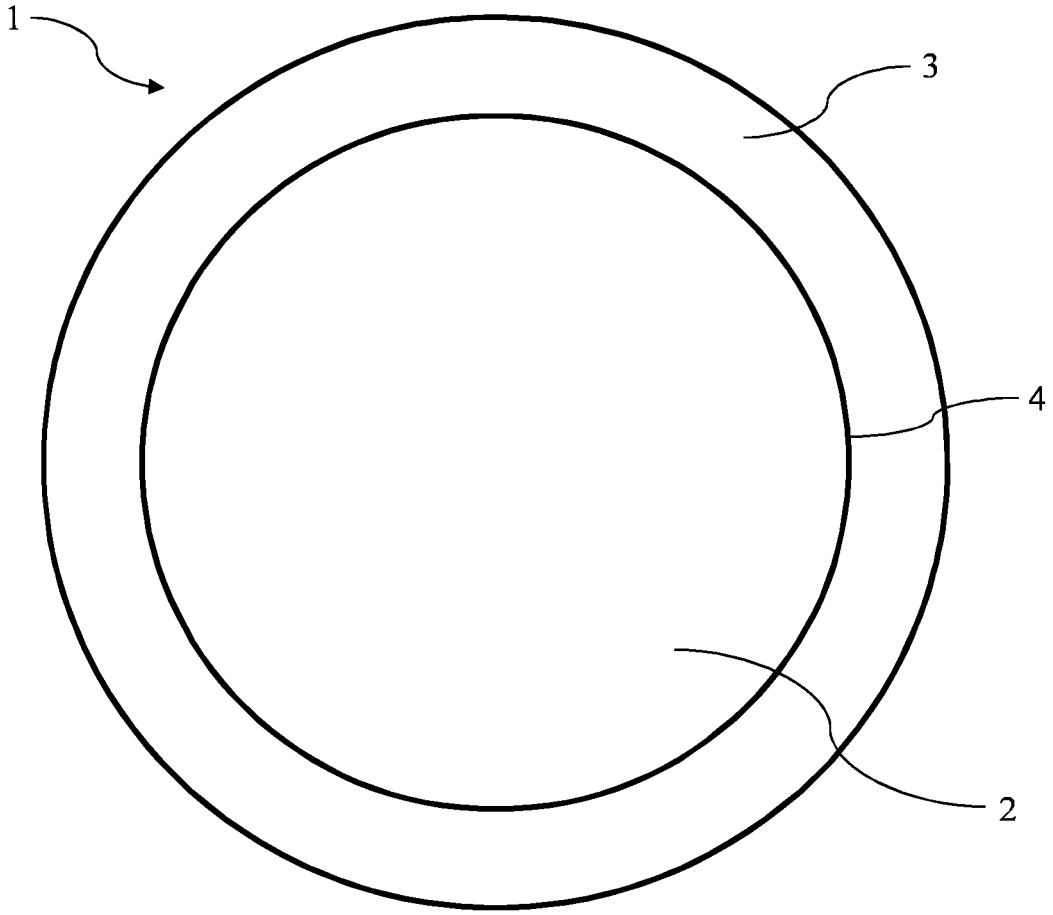
FIG. 1 is a cross-sectional view of a monofilament string of the present invention.

According to FIG. 1, the monofilament string 1 comprises a core 2 consisting of a single filament, and a sheath 3 extending around the core and in contact with the core. The core 2 has a round cross section and the sheath 3 has an annular cross section, the sheath being coaxial with the core.

Definitions of several terms used further in the description are given below.

The term "rigidity" used herein refers to the tensile modulus (also called "Young's modulus" or modulus of elasticity") of a material. A material with a high rigidity presents a high tensile modulus and thus a low elasticity.

The term "geometric stiffness" used herein is similar to the term "rigidity" but relates to a structure. The geometric stiffness of the structure depends on the rigidity of the material it is made of and on its dimensional characteristics.

In reference with FIG. 1, the core 2 is made of a first material comprising a first copolymer of polyamide 6 and polyamide 6.6 (first copolymer PA 6/6.6), and the sheath is made of a second material comprising a second copolymer of polyamide 6 and polyamide 6.6 (second copolymer PA 6/6.6, which may be the same as the first copolymer).

Polyamide 6 and polyamide 6.6 are thermoplastic semi-crystalline polymers that exhibit good mechanical properties. They are both quite rigid polymers although polyamide 6 has a higher tensile modulus than polyamide 6.6.

As an example, the tensile modulus of the polyamide 6 generally ranges between 700 MPa (Mega Pascal) and 800 MPa, whereas the tensile modulus of the copolymer PA 6/6.6 generally ranges between 500 MPa and 600 MPa.

The mechanical properties of the copolymer PA 6/6.6 generally lie somewhere between those of the polyamide 6 and the polyamide 6.6. A block-copolymer PA 6/6.6 is preferred because the properties of the latter can be very close to the better properties of the polyamide 6 and the polyamide 6.6 without suffering from a corresponding loss in other desired properties, depending on the structure of the copolymer PA 6/6.6, the respective proportions of polyamide 6 and polyamide 6.6 in the copolymer PA 6/6.6, and the process of manufacturing of the copolymer PA 6/6.6.

As such, the copolymer PA 6/6.6 has a tensile strength comprised between that of the polyamide 6 and the polyamide 6.6, or substantially equal to that of the polyamide 6.6.

The first material is selected so as to have a greater tensile modulus than that of the second material.

To this end, the first material comprises, in addition to the first copolymer PA 6/6.6, polyamide 6. Polyamide 6 provides the first material with a high rigidity, as well as a strong ability to dissipate the mechanical efforts (energy) when deformed elastically.

Figure 2:
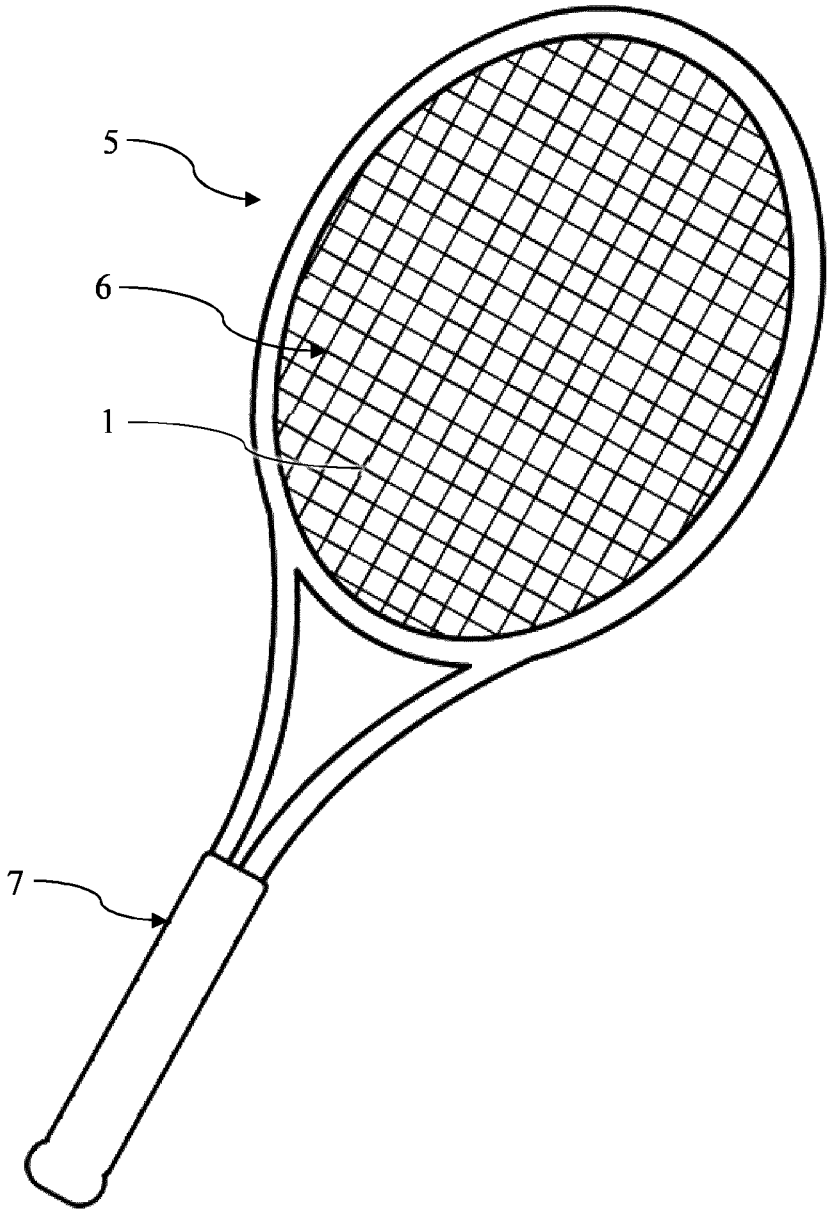
FIG. 2 is a schematic view of a racket comprising a set of monofilament strings according to the invention.

The core 2 thus provides the monofilament string 1 with a high geometric stiffness and the ability to strongly absorb/dissipate the mechanical efforts applied to it that occur when the string undergoes the impact of a ball or the like, which results in a better control of the ball as well as a reduction of the vibrations that propagate through the sieve 6 and the handle 7 of the racket 5 represented in FIG. 2.

One result is that the racket 5 allows the player to slow down the ball after receiving and hitting the ball for a better control of the ball. Another result is that the player receives fewer vibrations and shocks when hitting the ball for a better comfort thus preventing injuries such as tennis elbow for example in the case of a tennis racket.

Preferably, the sheath does not contain polyamide 6. However, it has to be understood that the second material can possibly comprise polyamide 6, but in a significantly lower amount compared to the first material. In this situation, the percentage by weight of polyamide 6 in the second material (relative to the second material) is significantly lower than the percentage by weight of polyamide 6 in the first material (relative to the first material).

Similarly, the amount of polyamide 6 in the copolymers PA 6/6.6 of the first and second materials is also adjusted so that the tensile modulus of the first material is greater than the tensile modulus of the second material. Advantageously, the percentage by weight of polyamide 6 in the copolymer PA 6/6.6 of the second material is lower than the percentage by weight of polyamide 6 in the copolymer PA 6/6.6 of the first material.

As a consequence, the second material (sheath) has a lower tensile modulus than the first material (core). Hence, the second material is more elastic, absorbs less energy when deformed elastically and releases more energy than the first material.

The sheath 3 thus provides the monofilament string 1 with the ability to strongly release the mechanical efforts applied to said string when the string undergoes the impact of a ball or the like.

One result is that is that the racket allows the player to strongly accelerate the ball when hitting it.

The string 1 is obtained by co-extrusion of the core 2 and the sheath 3.

Coextruding the core 2 and the sheath 3 forms an interface 4 at the contact zone between the core and the sheath where said core and sheath are intimately linked.

As described previously, the core 2 and the sheath 3 of the string 1 have similarities in terms of chemical structure. Both the core and the sheath indeed are made of a polyamide-based material, namely a copolymer PA 6/6.6.

The strong mechanical and chemical cohesion of the core 2 and the sheath 3 at the interface 4 represented in FIG. 1 allows said core and sheath to act in synergy when the string is requested mechanically, thus further improving the overall mechanical properties of the string, in particular its durability as well as its ability to influence the spin of the ball.

In the string, the weight proportion of the sheath 3 is small compared to the weight proportion of the core 2. In particular, the sheath preferably represents from 5% to 20% by weight, more preferably from 8% to 16% by weight, of the total weight of the string 1. The core preferably represents from 80% to 95% by weight, more preferably from 84% to 92% by weight, of the total weight of the string.

In terms of thickness the thickness of the sheath 3 represents from 2% to 7%, preferably from 3% to 6%, of the total thickness of the string 1, and the thickness of the core 2 represents from 93% to 98%, preferably from 94% to 97%, of the total thickness of the string 1.

In more details, the thickness of the sheath ranges preferably from 20 and 50 micrometers while the thickness (which corresponds to the diameter) of the core ranges from 1200 and 1500 micrometers.

Such high weight proportion of the core relative to the sheath allows, along with the composition of the first and second materials of the core and the sheath, having a string with high control properties.

Surprisingly, despite its resulting low weight proportion, the sheath is however sufficient to provide the string with high power properties, in particular by imparting to the string explosive properties. By "explosive" is meant in the present text that the racket returns the ball with a great speed.

The combination of the core and sheath thus provides a good balance between control properties and power properties.

Of course, depending on the intended way of playing of the user, the compositions and proportions of the core and the sheath may be adjusted to provide an optimal trade-off between control and power properties.

Another aspect having an impact on power properties of racket strings is the slide of the strings relative to each other and the friction generated by the contact of the strings when sliding. In more details, when a player hits a ball, the ball engages the strings, causing them to bend and thus to slide relative to each other in a first direction while being pressed against each other. After hitting the ball, the ball comes out of the strings, causing them to get back to their initial rest position and to slide relative to each other in a second direction opposite to the first direction.

In order to reduce the friction between the strings when sliding, the sheath advantageously comprises one or more additive(s) that facilitate the slide of the strings relative to each other thus providing the strings with enhanced dynamic and bouncing capacities, and in general, enhanced power properties.

The additives are preferably selected from the group consisting of: slip agents and hydrophobic agents.

Among slip agents, the preferred additives are selected from: erucamide, such as stearyl erucamide, ethylene bis stearamide, polyamide-based polydimethylsiloxane, polyamide-based siloxane with ultra-high molecular mass, fluorine-based polymer, polymer loaded with molybdenum disulfide.

Among hydrophobic agents, the preferred additives are selected from: siloxane-based polymer with ultra-high molecular mass, polydimethylsiloxane-based polymer, silicon dioxide-based compounds, ceramic nanoparticles-based compounds.

For the purpose of reducing the friction between the strings when sliding, a coating of such additives or other substances can also be applied on the peripheral surface of the sheath, in particular during the manufacture of the strings.

According to an embodiment, in addition to or as an alternative to the presence of slip agents or hydrophobic agents in the sheath, a coating may be applied onto the outer surface of the sheath. Said coating may have non-slip and/or water repelling properties.

The monofilament string 1 according to the invention thus has the following properties:

- a shock-absorbing capacity provided by the core 2, due to its low elasticity;
- a dynamic and bouncing capacity provided by the sheath 3, due to its high elasticity and low friction;
- high durability properties with a reduced degradation of its structure and tension over time and use, due to the relatively high tensile module of polyamide 6 and copolymer PA 6/6.6, the previous properties, as well as the overall mechanical properties of the string, being further improved with the co-extrusion of the core and sheath, and the formation of the interface 4 in between.

As a result, the monofilament string shows a good balance between power and control properties, while also having good comfort and durability properties.

Another aspect of the invention relates to a process for manufacturing a monofilament string as disclosed above.

A first step of the process is a co-extrusion of the core and the sheath to make a string. According to the general principle of co-extrusion, an extrusion die is supplied with extrusion lines of a first material intended to form the core of the string and a second material intended to form the sheath of the string.

As already explained, co-extrusion of the core and the sheath allows creating an interface at the contact zone of the core and the sheath to increase the mechanical properties of the string.

At least one additive described previously can be added, preferably continuously, during at least one part of the co-extrusion step. Moreover, the additive is preferably added to the second material at the outer surface of the sheath.

The process further comprises stretching the monofilament string under determined temperature and humidity conditions.

The process further comprises a first stretching of the string by applying a first predetermined traction force on the string. The value of the traction force is chosen according to:

- the tensile strength and the elongation at break of the string, both determinable by appropriate tensile test,
- the desired mechanical properties of the manufactured string.

This first stretching may be carried out directly following the exit of the monofilament from the extrusion die.

Advantageously, a second stretching of the string is then carried out by applying a second predetermined traction force on the string. The value of the second traction force is preferably lower than that of the first traction force.

The stretching ratio, which is the ratio of the length of the co-extruded string in the stretched state to the length of the co-extruded string in the relaxed state, is preferably comprised between 1 and 10, more preferentially between 3.5 and 4.5 for the first stretching, and between 1 and 2, more preferably between 1.05 and 1.55 for the second stretching.

Due to the fact that the core and the sheath are intimately linked by the co-extrusion process, the stretching has an effect on mechanical properties of both the core and the sheath.

According to a first embodiment, the first and second stretching steps are continuous. The second stretching is performed right after the first stretching, after the string got back to the relaxed position.

According to a second embodiment, the first and second stretching steps are sequential. The string is let at rest for a predetermined amount of time after the first stretching, then the second stretching is performed.

Each stretching step increases the tensile modulus of both the core and the sheath, with the sheath being more impacted than the core. This increases the geometric stiffness of the string, but also provides the string with high mechanical stability, in particular increased tension maintenance.

The elastic deformation of the string after the stretching steps is indeed reduced compared to the string before the stretching steps, and maintained substantially constant for an extended amount of time when used.

Of course, more than two stretching steps, continuous or sequential, may be carried out without departing from the scope of the present invention.

The monofilament string as described above can be used in a racket for tennis, squash, badminton, or the like, a set of such monofilament strings being stretched across the hoop of the racket in two orthogonal directions.

EXAMPLE

Example 1: Elastic Deformation of Different Strings

Experimental measures of elastic deformation of a monofilament string according to the invention and existing monofilament and multifilament strings are carried out.

The string samples are the following:

- String A: monofilament string of the invention after a first stretching with a stretching ratio of 4, comprising a core made of 80% by weight of polyamide 6 and 20% by weight of a copolymer PA 6/6.6, relative to the weight of the core, and a sheath consisting of copolymer PA 6/6.6. The polyamide 6 has a tensile modulus that ranges between 700 MPa and 800 MPa, and the copolymer PA 6/6.6 has a tensile modulus that ranges between 500 MPa and 600 MPa. The string has a diameter of 1.28 millimeters.
- String B: corresponds to string A after a second stretching with a stretching ratio of 1.1.
- String C: corresponds to string A after a second stretching with a stretching ratio of 1.15.
- String D: multifilament string in polyurethane, with a diameter of 1.3 millimeters.
- String E: monofilament string in polyamide 6, 10, with a diameter of 1.3 millimeters.
- String F: monofilament string in polyester (PET), with a diameter of 1.25 millimeters.

Figure 3:
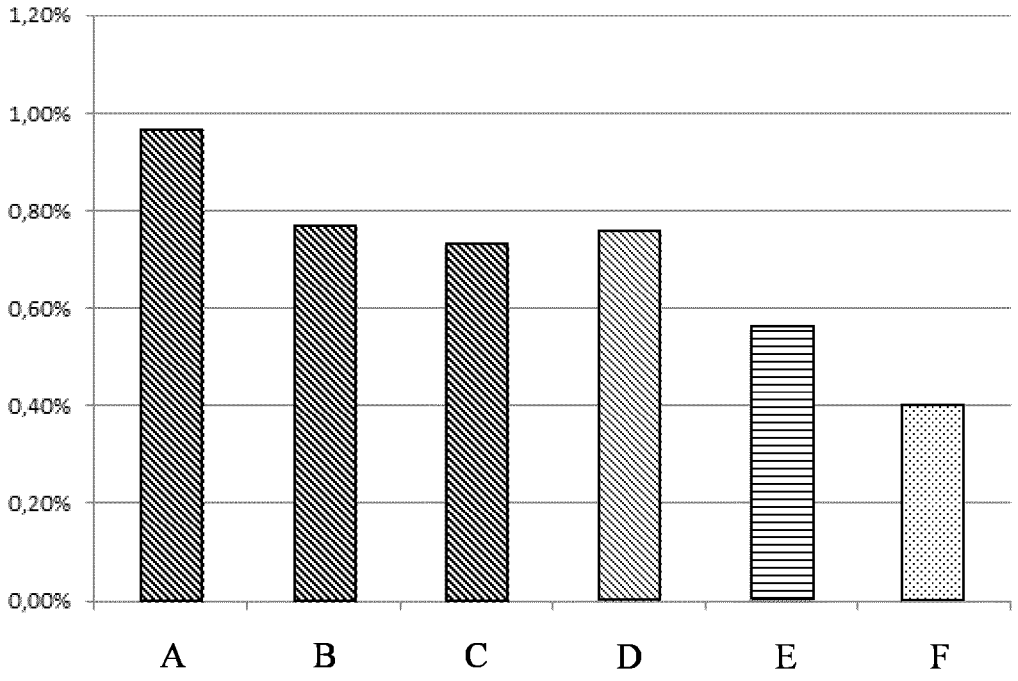
FIG. 3 is a graph showing the elastic deformation of a monofilament string according to the invention compared to existing monofilament and multifilament strings.

Each string sample undergoes a hundred cycles of tensile stress: the sample is stretched and relaxed a hundred times. For each cycle, the elastic deformation of the string is measured and the mean value of the deformation of the string over the hundred cycles is calculated. The elastic deformation corresponds to the ability of the string to deform reversibly. The elastic deformation and the corresponding mean value are expressed in percentages, which are percentage ratios of the length of the string in the stretched state to the length of the string in the relaxed state. The results are illustrated on the graph of FIG. 3.

In view of the results, the elastic deformation percentage of stretched string A is greater than that of the others strings, and decreases after the second stretching (strings B and C) from 0.96% to 0.72%, very close to the 0.75% of string D. Hence, the second stretching decreases the elasticity of the string. Yet, the resulting strings B and C deforms reversibly more than strings E and F and substantially equally to string D, while having better control and durability properties.

Example 2: Tension Maintenance of Different Strings

Figure 4:
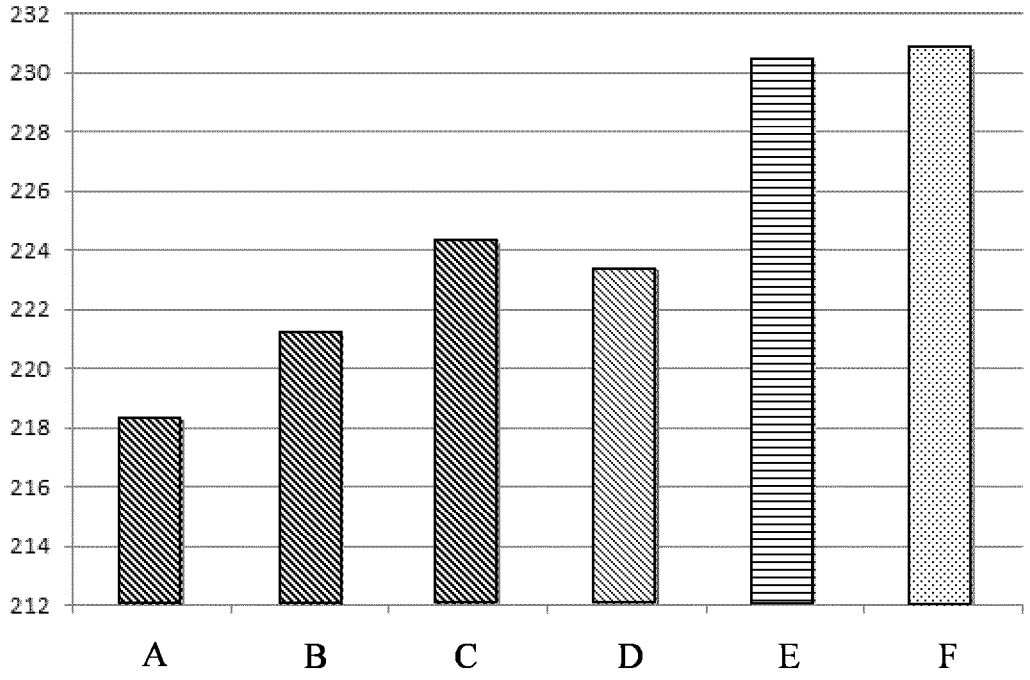
FIG. 4 is a graph showing the tension maintenance of a monofilament string according to the invention compared to existing monofilament and multifilament strings.

The string samples are the same as in Example 1. Each string sample undergoes a tensile stress, of an initial value of 250 Newton (N), for a duration of 10 minutes. The tensile stress of the string samples naturally decreases as the time passes. After 10 minutes, the remaining tensile stress applied to each string sample is measured, and corresponds to the tension maintenance of the string, in Newton (N). The results are illustrated on the graph of FIG. 4.

In view of the results, the tension maintenance of the string after the first stretching (string A) is lower than that of all the other strings. The second stretching (strings B and C) increases the tension maintenance of the string from about 218 N for string A to about 221 N for string B and about 224 N for string C, very close to the 223.5 N of string D and lower than the 230 N of string E and 230.5 N of string F.

REFERENCES

FR 2 934 958

The invention claimed is:

1. A monofilament string for a racket, comprising a core consisting of a single filament and a sheath extending around the core and in contact with the core, wherein:

- the core is made of a first material comprising polyamide 6 and a first copolymer of polyamide 6 and polyamide 6.6,
- the sheath is made of a second material comprising a second copolymer of polyamide 6 and polyamide 6.6,
- the first material having a greater tensile modulus than the second material.

2. The monofilament string of claim 1, wherein the first material comprises:

from 70% to 90% by weight of polyamide 6 with reference to the total weight of the first material, from 10% to 30% by weight of the first copolymer of polyamide 6 and polyamide 6.6 with reference to the total weight of the first material.

3. The monofilament string of claim 1, wherein the second material consists of the second copolymer of polyamide 6 and polyamide 6.6.

4. The monofilament string of claim 1, wherein the sheath represents from 5% to 20% by weight of the total weight of the string.

5. The monofilament string of claim 1, wherein the core represents from 80% to 95% by weight of the total weight of the string.

6. The monofilament string of claim 1, wherein the thickness of the sheath represents from 2% to 7% of the total thickness of the string.

7. The monofilament string of claim 1, wherein the thickness of the core represents from 93% to 98% of the total thickness of the string.

8. The monofilament string of claim 1, wherein the core has a thickness comprised between 1200 and 1500 micrometers, and the sheath has a thickness comprised between 20 and 50 micrometers.

9. The monofilament string of claim 1, wherein the second material further comprises at least one additive selected from the group consisting of: slip agents and hydrophobic agents.

10. The monofilament string of claim 1, wherein said monofilament string is obtained by co-extrusion of the core and the sheath.

11. A racket comprising a set of monofilaments strings according to claim 1.

12. A process for manufacturing a monofilament string for a racket according to claim 1, said process comprising a co-extrusion of the core and the sheath to make the string and at least one stretching step of the string.

13. The process of claim 12, further comprising the following steps:

a first stretching of the co-extruded string by applying a first predetermined traction force, wherein the ratio of the length of the co-extruded string in the stretched state to the length of the co-extruded string in the relaxed state is comprised between 1 and 10, a second stretching of the string by applying a second predetermined traction force, wherein the ratio of the length of the co-extruded string in the stretched state to the length of the co-extruded string in the relaxed state is comprised between 1 and 2.

14. The process of claim 13, wherein the first and second stretching steps are continuous.

15. The process of claim 13, wherein the first and second stretching steps are sequential.

16. The process of claim 12, wherein at least one additive selected from the group consisting of slip agents and hydrophobic agents, is added to the second material during the co-extrusion step.

* * * * *